US005796343A

United States Patent [19]

Stauder

[11] Patent Number: 5,796,343

[45] Date of Patent: Aug. 18, 1998

[54] DEVICE AND METHOD FOR PREVENTING DAMAGE TO GOODS DURING HANDLING BY MATERIAL HANDLING EQUIPMENT

[76] Inventor: Gary D. Stauder, 1705 N. Hullen, Metairie, La. 70001

[21] Appl. No.: 695,528

[22] Filed: Aug. 12, 1996

Related U.S. Application Data

[63] Continuation-in-part of Ser. No. 303,447, Sep. 9, 1994, abandoned.

[51] Int. Cl.[6] ..... G08B 21/00

[52] U.S. Cl. ..... 340/626; 340/688; 91/1; 60/328

[58] Field of Search ..... 340/626, 688; 91/1; 60/328; 414/347

[56] References Cited

U.S. PATENT DOCUMENTS

| | | | |
|---|---|---|---|
| 2,570,125 | 10/1951 | Hoare et al. | 340/688 |
| 4,013,185 | 3/1977 | Bratton | 214/621 |
| 4,640,657 | 2/1987 | Moore et al. | 414/347 |
| 4,906,977 | 3/1990 | Huey-Jeng | 340/626 |
| 5,121,109 | 6/1992 | Murphy et al. | 340/688 |
| 5,305,680 | 4/1994 | Weber | 91/1 |
| 5,357,242 | 10/1994 | Morgano | 340/626 |

*Primary Examiner*—Jeffery Hofsass
*Assistant Examiner*—Julie B. Lieu
*Attorney, Agent, or Firm*—Joseph N. Breaux

[57] ABSTRACT

An alarm device, an improved squeeze-pad hydraulic system for a squeeze truck, and a method for converting an existing squeeze-pad hydraulic system of a squeeze truck into a squeeze-pad hydraulic system that alerts the operator of the squeeze truck when dangerously high hydraulic pressures are approached within the squeeze-pad hydraulic system are described. The alarm device comprises: an alerting device, operationally responsive to an electrical signal, having an input terminal for receiving the electric signal, and an alarm threshold switch comprising: a pressure transducing element in fluid communication with the hydraulic lines in a manner such that hydraulic fluid within the hydraulic fluid lines will exert a pressure on the pressure transducing element, and an electrical switching device, in electrical connection with the input terminal, for directing the electrical signal to the input terminal. The electrical switching device is responsive to the pressure transducing element in a manner such that the electrical switching device directs the electrical signal to the input terminal when a predetermined pressure is placed on the pressure transducing element by the hydraulic fluid.

3 Claims, 3 Drawing Sheets

DEVICE AND METHOD FOR PREVENTING DAMAGE TO GOODS DURING HANDLING BY MATERIAL HANDLING EQUIPMENT

This application is a continuation-in-part of application Ser. No. 08/303,447, filed Sep. 9, 1994, now abandoned.

TECHNICAL FIELD

The present invention relates to devices and methods for preventing damage to goods during handling by material handling equipment, and more particularly to devices and methods for preventing damage to goods during handling by material handling equipment that alert the operator of the material handling equipment that conditions are favorable for damage to occur.

BACKGROUND ART

Material handling equipment, such as squeeze trucks, are commonly used for lifting and moving goods within storage facilities such as warehouses. Squeeze trucks operate by squeezing the goods between two hydraulically operated squeeze pads with a force sufficient to allow the item to be lifted. Although the hydraulic system of these devices are generally equipped with a hydraulic pressure limiting system, it is a continual problem with this type of material handing device that the item being lifted is crushed and/or damaged by the application of too great a hydraulic pressure to the squeeze pads. The failure of existing pressure limiting systems to prevent crushing of goods is generally attributable to two factors: component failure and exceeding the system's operating parameters.

When a component, such as a pressure relief valve, within the pressure limiting system fails, the pressure limiting system cannot function to limit the hydraulic pressure supplied to the squeeze pads. Once the pressure limiting system is inoperable, the hydraulic pressure supplied to the squeeze pads is unregulated and over-pressure conditions can occur. Operation of the squeeze truck when these over-pressure conditions are occurring can cause the squeeze pads to crush the goods being lifted. It would be desirable, therefore, to have a device which would alert the operator of the squeeze truck that dangerously high hydraulic pressures were being generated. The operator could then halt operation of the squeeze truck and have the system repaired before the unregulated hydraulic pressures resulted in damage to any goods.

The second factor, exceeding the system's operating parameters, occurs when the squeeze truck is improperly operated. An example of a common improper operation is revving the engine of the squeeze truck. Because the hydraulic pumping system of a squeeze truck is ordinarily connected to the drive engine, revving the drive engine can cause fluctuations in hydraulic pressure within the hydraulic system connected to the squeeze pads. These pressure fluctuations occur at rates beyond the pressure limiting systems ability to regulate. Unregulated pressure fluctuations can cause the squeeze pads to crush and/or damage the goods being lifted. It would, therefore, also be desirable to have a device which would alert an operator when improper operation of the squeeze truck was resulting in dangerously high hydraulic pressures within the squeeze pad hydraulic system before such improper operation resulted in damaged goods.

GENERAL SUMMARY DISCUSSION OF INVENTION

It is thus an object of the invention to provide a device for preventing damage to goods being handled by a squeeze truck that alerts the operator of a squeeze truck when dangerously high hydraulic pressures are being approached within the squeeze-pad hydraulic system.

It is a further object of the invention to provide an improved squeeze-pad hydraulic system for a squeeze truck that alerts the operator of the squeeze truck when dangerously high hydraulic pressures are approached within the squeeze-pad hydraulic system.

It is a still further object of the invention to provide a method for converting an existing squeeze-pad hydraulic system of a squeeze truck into a squeeze-pad hydraulic system that alerts the operator of the squeeze truck when dangerously high hydraulic pressures are approached within the squeeze-pad hydraulic system.

Accordingly, in one aspect of the invention, an alarm device for alerting the operator of a squeeze truck when a predetermined hydraulic pressure is reached within the squeeze-pad hydraulic system of the squeeze truck is provided. The device comprises: an alerting device, for alerting the operator that the predetermined hydraulic pressure has been reached; and an alarm threshold switch, in electrical connection with the alerting device, for activating the alerting device when the predetermined hydraulic pressure is reached.

The alerting device may be any electrically responsive device that will cause the attention of the operator to be drawn to the pressure conditions then present within the squeeze-pad hydraulic system. Suitable alerting devices include electrically operated or actuated: horns, flashing lights, buzzers, vibrators, etc.. The alerting device includes an input terminal for receiving an electrical control signal. Upon receipt of the electrical control signal at the input terminal, the alerting device operates—attracting the attention of the operator. The term "input terminal" is used herein to mean any device, mechanism, or artifice, in electrical connection with the operative or actuating element of the alerting device, to which an electrical connection may be made.

The alarm threshold switch comprises: a pressure transducing element, an elongated indicating member, and an electrical contact member. The pressure transducing element must be able to withstand pressures above the normal operating pressures of the squeeze-pad hydraulic system. A pressure range of zero to ten-thousand P.S.I. is generally sufficient. Of course, in applications where greater hydraulic pressures are required, a pressure transducing element capable of withstanding greater pressures must be used.

The indicating member must include an electrically conductive pathway running along at least a portion thereof. The indicating member may be constructed of an electrically conductive material such as a metal. The indicating member is operationally connected to the pressure transducing element and is responsive to the pressure transducing element in a manner such that the indicating member moves along a predetermined path in response to changes in the pressure placed on the pressure transducing element. The term "operational connection" is used herein to mean a connection that allows the pressure transducing element to cause movement of the indicating member. The pressure transducing element need not be in actual physical contact with the indicating member, although this is certainly within the scope of the term. The position of the indicating member should indicate the pressure being placed on the pressure transducing element.

The electrical contact member is electrically isolated from the conducting pathway of the indicating member and is positioned in relation to the indicating member in a manner such that the conducting pathway of the indicating member contacts and forms a series electrical relationship with the contact member when the indicating member reaches a predetermined position corresponding to a desired alarm threshold. The input terminal of the alerting device is in electrical connection with the series electrical relationship formed by contact between the contact member and the conducting pathway of the indicating member.

It is preferred to use an alerting device which generates audible sound as a means for attracting the operators attention. It is also preferred to use an alerting device which utilizes a light source for creating visible light of sufficient intensity to attract the attention of an operator looking in a direction away from the light source as the means for attracting the operators attention. It is preferred that the position of the contact member in relation to the indicating member be adjustable by an operator. The adjustability of the alarm threshold allows the alarm to be utilized conveniently when lifting items requiring different squeezing pressures.

In another aspect of the invention there is provided an improved hydraulic system for use in actuating the squeeze-pads of a squeeze truck. The improvement is to a hydraulic system of the type comprising: a pump, a hydraulic cylinder, a piston slidably disposed within the hydraulic cylinder, hydraulic lines in fluid connection between the pump and the hydraulic cylinder, and a hydraulic pressure limiting mechanism, such as a pressure relief valve, in fluid communication with the hydraulic lines, for limiting the pressure of hydraulic fluid within the hydraulic system during use. The improvement comprises: an alerting device, operationally responsive to an electrical signal, having an input terminal for receiving the electric signal, and an alarm threshold switch comprising: a pressure transducing element in fluid communication with the hydraulic lines in a manner such that hydraulic fluid within the hydraulic fluid lines will exert a pressure on the pressure transducing element, and an electrical switching device, in electrical connection with the input terminal, for directing the electrical signal to the input terminal. The electrical switching device is responsive to the pressure transducing element in a manner such that the electrical switching device directs the electrical signal to the input terminal when a predetermined pressure is placed on the pressure transducing element by the hydraulic fluid.

The pressure transducing element must be able to withstand pressures greater than the normal operating pressures of the squeeze-pad hydraulic system. A pressure range of zero to ten-thousand P.S.I. is generally sufficient. Of course, in applications where greater hydraulic pressures are required a pressure transducing element capable of withstanding greater pressures must be used.

In a preferred embodiment of the improved hydraulic system, the electrical switching device comprises an elongated indicating member, and an electrical contact member. The indicating member includes an electrically conductive pathway running along at least a portion thereof. The indicating member may be constructed of an electrically conductive material such as a metal. The indicating member is operationally connected to the pressure transducing element and is responsive to the pressure transducing element in a manner such that the indicating member moves along a predetermined path in response to changes in the pressure being placed on the pressure transducing element. The position of the indicating member should indicate the pressure being placed on the pressure transducing element.

The electrical contact member is electrically isolated from the conducting pathway of the indicating member and is positioned in relation to the indicating member in a manner such that the conducting pathway of the indicating member contacts and forms a series electrical relationship with the electrical contact member when the indicating member reaches a predetermined position corresponding to a desired alarm threshold. The input terminal of the alerting device is in electrical connection with the series electrical relationship formed by contact between the electrical contact member and the conducting pathway of the indicating member.

It is preferred to use an alerting device which generates audible sound as a means for attracting the operators attention. It is also preferred to use an alerting device which utilizes a light source for creating visible light of sufficient intensity to attract the attention of an operator looking in a direction away from the light source as the means for attracting the operators attention. It is preferred that the position of the electrical contact member in relation to the indicating member be adjustable by an operator. The adjustability of the alarm threshold allows the alarm to be utilized conveniently when lifting items requiring different squeezing pressures.

In another aspect of the invention there is provided a method for converting an existing squeeze-pad hydraulic system for a squeeze truck into a squeeze-pad hydraulic system that alerts the operator of the squeeze truck when predetermined hydraulic pressures are reached within the squeeze-pad hydraulic system. The existing squeeze-pad hydraulic system is of the type comprising: a pump, a hydraulic cylinder, a piston slidably disposed within the hydraulic cylinder, hydraulic lines in fluid connection between the pump and the hydraulic cylinder, and a hydraulic pressure limiting mechanism, such as a pressure relief valve, in fluid communication with the hydraulic lines, for limiting the pressure of hydraulic fluid within the squeeze-pad hydraulic system during use.

The conversion method comprises the steps of: a) providing an alarm threshold switch comprising: a pressure transducing element, and an electrical switching device, responsive to the pressure transducing element in a manner such that the electrical switching device directs an electrical signal when a predetermined pressure is placed on the pressure transducing element; b) installing the alarm threshold switch in fluid communication with the hydraulic lines in a manner such that the hydraulic fluid exerts a pressure on the pressure transducing element; and c) forming an electrical connection between the electrical switching device and an input terminal of an alerting device that is operationally responsive to an electrical signal.

In a preferred embodiment of the conversion method, the electrical switching device provided comprises an elongated indicating member, and an electrical contact member. The indicating member includes an electrically conductive pathway running along at least a portion thereof. The indicating member may be constructed of an electrically conductive material such as a metal. The indicating member is operationally connected to the pressure transducing element and is responsive to the pressure transducing element in a manner such that the indicating member moves along a predetermined path in response to changes in the pressure placed on the pressure transducing element. The position of the indicating member should indicate the pressure being placed on the pressure transducing element.

The electrical contact member is electrically isolated from the conducting pathway of the indicating member and is positioned in relation to the indicating member in a manner such that the conducting pathway of the indicating member contacts and forms a series electrical relationship with the electrical contact member when the indicating member reaches a predetermined position corresponding to a desired alarm threshold. In this preferred method, the formation of the electrical connection between the input terminal of the alerting device and the electrical switching device is performed is performed by wiring the input terminal in series with the series electrical relationship formed by contact between the electrical contact member and the conducting pathway of the indicating member.

It is preferred that the alerting device to which the electrical connection is formed generate audible sound as a means for attracting the operators attention. It is still more preferred that the alerting device be the horn of the squeeze truck. It is also preferred that the alerting device utilize a light source for creating visible light of sufficient intensity to attract the attention of an operator looking in a direction away from the light source as the means for attracting the operators attention.

It is also preferred to provide an electrical switching device, of the type having an indicating member and a electrical contact member, in which the position of the electrical contact member, in relation to the indicating member, is adjustable by an operator. Adjustable positioning of the electrical contact member allows the alarm threshold to be changed when lifting items requiring different squeezing pressures.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
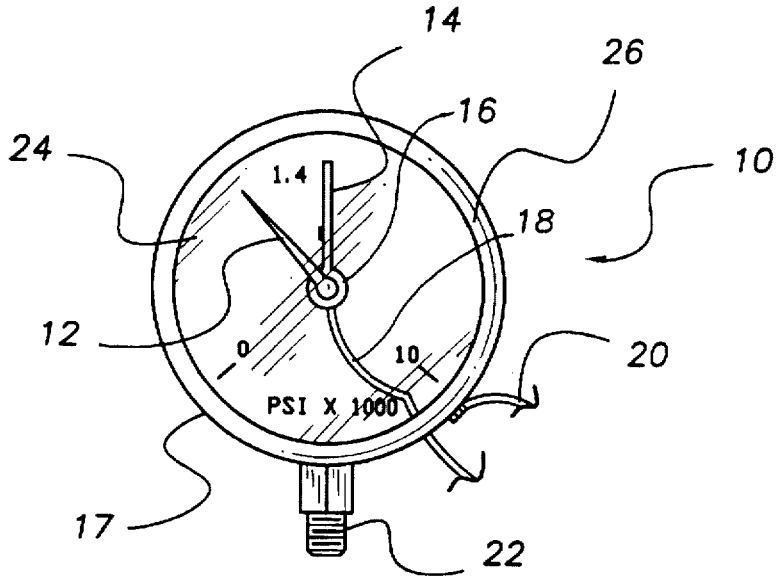
FIG. 1 is a frontal view of a preferred alarm threshold switch.

FIG. 1 shows a frontal view of one embodiment of the alarm threshold switch 10 of the present invention. As shown in FIG. 1, alarm threshold switch 10 includes housing 11, elongated indicating member 12, electrical contact member 14, adjusting knob 16, first conducting wire 18, second conducting wire 20, threaded connection fitting 22, dial face 24, and transparent cover plate 26. Also included, but not shown in FIG. 1, are a pressure transducing element and a coupling mechanism.

Figure 2:
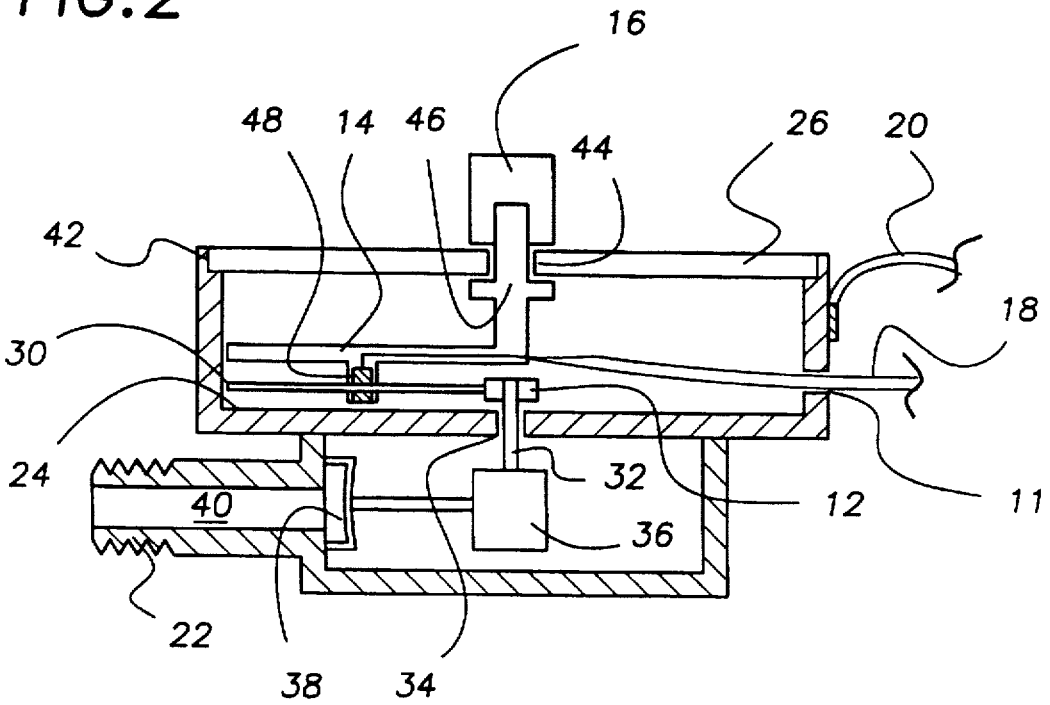
FIG. 2 is a longitudinal cross-sectional view of the alarm threshold switch of FIG. 1.

The internal connections and operation of alarm threshold switch 10 is now discussed with reference to FIG. 2. As shown in the figure, housing 11 includes a cylindrical cavity 28 within which indicating member 12 and electrical contact member 14 are enclosed. Indicating member 12 includes an indicating portion 30 and a shaft portion 32. Shaft portion 32 is rotatably installed through an aperture 34 and coupled to coupling mechanism 36 at one end. Coupling mechanism 36 is connected to pressure transducing element 38. Inlet chamber 40 provides a pathway for hydraulic fluid to contact pressure transducing element 38 when threaded connection fitting 22 is connected in fluid connection with the hydraulic lines of a squeeze-pad hydraulic system. In this embodiment pressure transducing element 38 is a diaphragm type pressure transducing element which changes shape in a predictable manner when exposed to pressure through inlet chamber 40. As pressure transducing element 38 changes shape, it causes the coupling mechanism 36 to rotate shaft portion 32 and in-turn indicating portion 30. Indicating portion 30, therefore changes position, in response to changing pressures placed on pressure transducing element 38 and its position at any given time indicates the current pressure of the hydraulic fluid. Dial face 24 includes indicia which allows the operator to read the hydraulic pressure conveniently.

In this embodiment indicating member 12 and housing 11 are constructed of electrically conductive metal. Second conducting wire 20 is attached to the outer surface of housing 11. Thus, an electrical current pathway exists that includes indicating portion 30, housing 11 and second conducting wire 20.

Transparent cover plate 26 is seated within a seating groove 42 formed around the interior peripheral edge of cylinder cavity 28. It is constructed of clear, non-conducting plastic and has an aperture 44 formed through its center. The shaft portion 46 of electrical contact member 14 is rotatably installed through aperture 44 and attached to adjusting knob 16. Adjusting knob 16 and shaft portion 46 are attached in a manner such that the position of electrical contact member 14 may be selected by grasping and rotating adjusting knob 16. The fit between shaft portion 46, adjusting knob 16 and aperture 44 is such that, once electrical contact member 14 is placed in a desired position, it will remain in place until readjusted.

In this embodiment, electrical contact member 14 includes a contact tab 48 which is attached to first conducting wire 18. Because electrical contact member is installed through the aperture 44 of transparent, non-conducting, plastic cover plate 26 it is electrically isolated from the current pathway formed by indicating portion 30, housing 11 and second conducting wire 20.

When indicating portion 30 is brought into contact with contact tab 48, the electrical isolation between electrical contact member 14 and the current pathway formed by indicating portion 30, housing 11 and second conducting wire 20 is broken allowing current to flow between first conducting wire 18 and second conducting wire 20.

Figure 3:
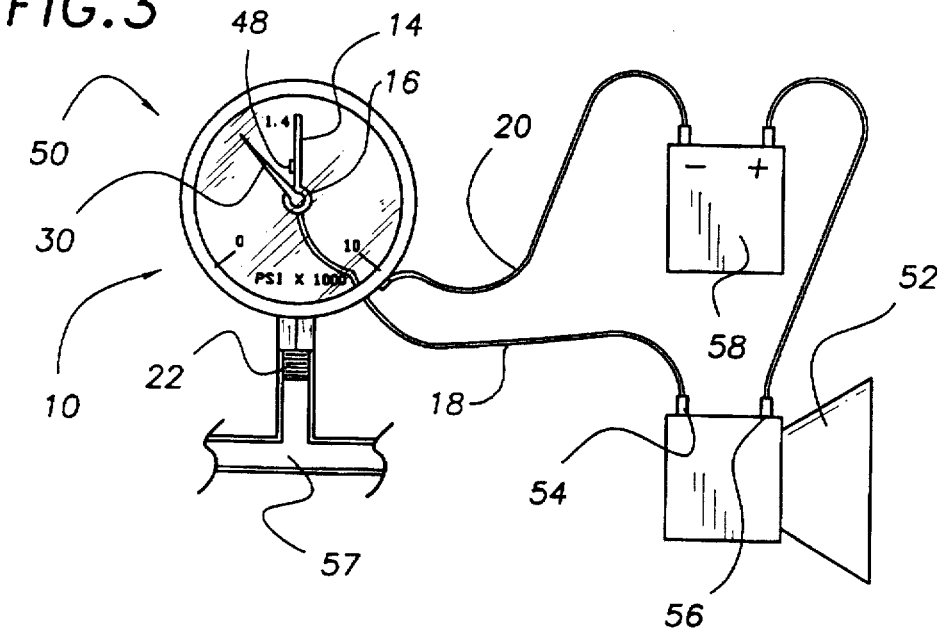
FIG. 3 is a schematic diagram of a preferred squeeze-pad hydraulic system.

FIG. 3 shows an embodiment of the alarm device 50 of the present invention showing alarm threshold switch 10 and a horn 52. Horn 52 is an electrically operated horn and includes a first input terminal 54 and a second input terminal 56. First conducting wire 18 is attached to first input terminal 54. It is preferred to use the horn of the squeeze truck.

The alarm device 50 is installed by connecting an electrical power source 58 between second conducting wire 20 and second input terminal 56; and connecting threaded connection fitting 22 to a hydraulic line 57 in a squeeze-pad hydraulic system in a manner such that hydraulic fluid fills inlet chamber 40 (not shown) and exerts hydraulic pressure against pressure transducing element 38 (not shown).

In use, the squeeze truck driver, or maintenance person, positions electrical contact member 14 into the position corresponding to the desired alarm set-point by grasping and rotating adjusting knob 16 until the desired position is reached. When the hydraulic pressure within the hydraulic line 57 of the pressure-pad hydraulic system reaches the predetermined set-point, indicating portion 30 is brought into contact with contact tab 48 allowing current to flow between first conducting wire 18 and second conducting wire 20. This current energizes horn 52, alerting the driver that the pressure level within the pressure-pad hydraulic system is at a level at which damage may be caused to items being moved.

The type of power source selected would depend upon the requirements of the alerting device selected. In this exemplary embodiment, electrical power source 58 is the DC battery of a squeeze truck.

Figure 4:
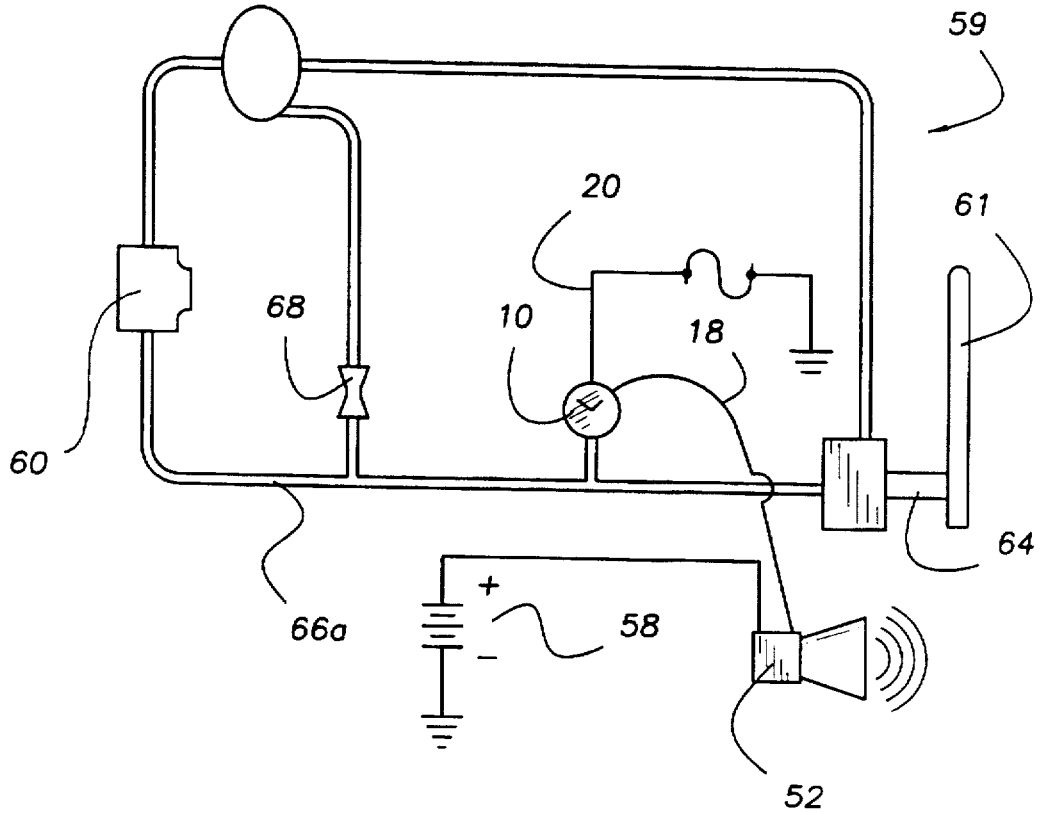
FIG. 4 is a schematic diagram of a second exemplary embodiment of a squeeze-pad hydraulic pressure monitoring system.

FIG. 4 is a schematic diagram of an embodiment of the improved hydraulic system 59, for use in actuating the squeeze-pads 61 of a squeeze truck. Squeeze-pad hydraulic systems are of the type comprising: a pump 60, a hydraulic cylinder 62, a piston 64 slidably disposed within the hydraulic cylinder 60, hydraulic lines 66 in fluid connection between the pump 60 and the hydraulic cylinder 62, and a hydraulic pressure limiting device 68, in operational connection with the hydraulic lines 66, for limiting the pressure of hydraulic fluid within the hydraulic system during use. The improvement to hydraulic system 58 includes the addition of alarm threshold switch 10 and horn 52 in the manner previously described. In this preferred embodiment the electrical power source 58 is the battery of the squeeze truck.

A preferred method of converting an existing squeeze-pad hydraulic system for a squeeze truck into a squeeze-pad hydraulic system that alerts the operator of the squeeze truck when a predetermined hydraulic pressure is reached within the squeeze-pad hydraulic system will now be described with reference to FIGS. 1–4.

The method consists of i) providing an alarm threshold switch 10 as previously described hereinabove; ii) connecting threaded connection fitting 22 to hydraulic line 66A in a manner such that hydraulic fluid fills inlet chamber 40 and exerts hydraulic pressure against pressure transducing element 38, connecting first conducting wire 18 to first input terminal 54 of the squeeze truck's horn 52, connecting second conducting wire 20 to the vehicle ground on the squeeze truck, and the positive terminal of the vehicle battery to second input terminal 56 of the 10 squeeze truck's horn 52.

Figure 5:
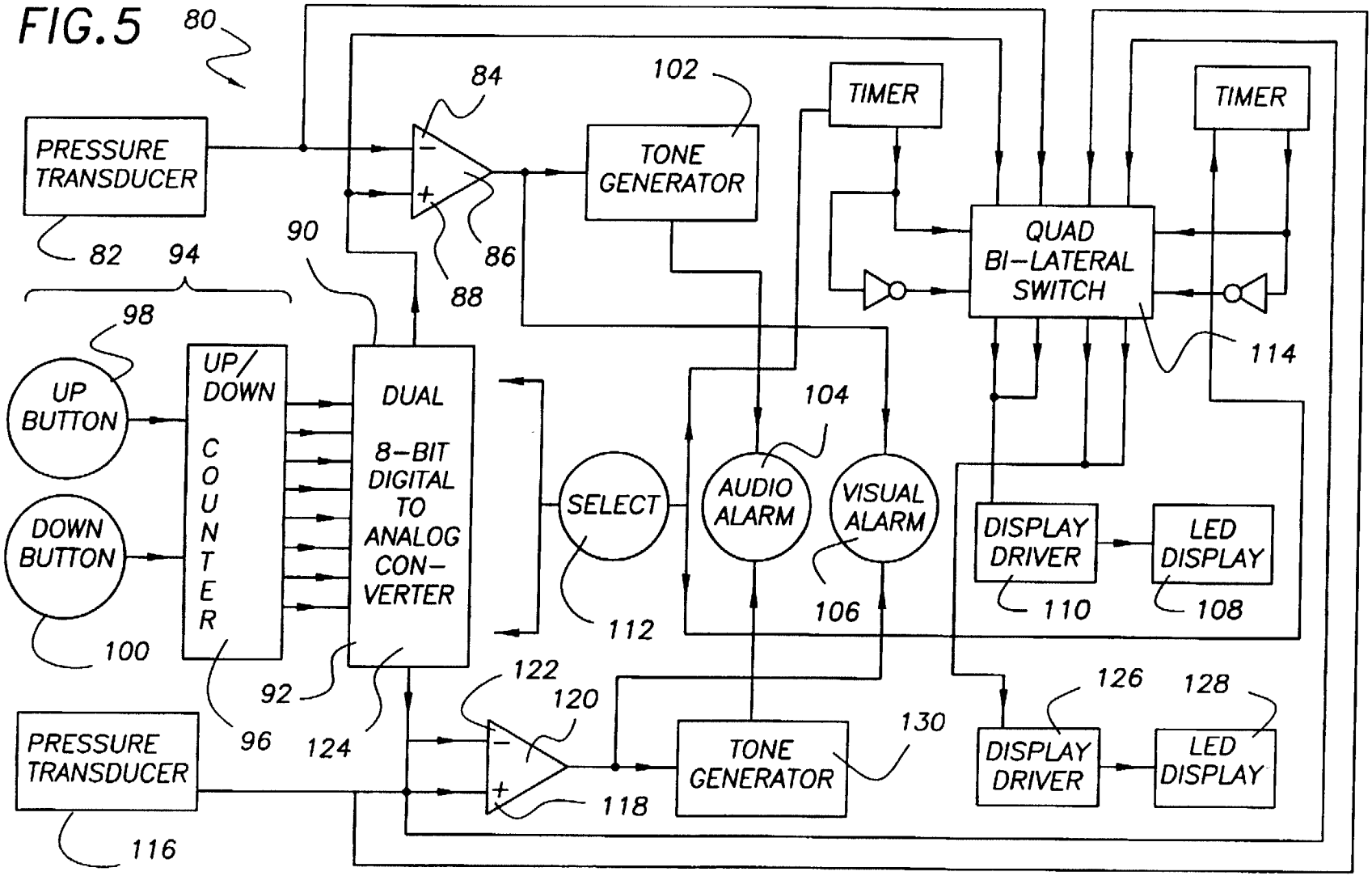
FIG. 5 is a schematic diagram of a third exemplary embodiment of a squeeze-pad hydraulic pressure monitoring system.

FIG. 5 shows a schematic diagram of a third exemplary embodiment of the improved squeeze-pad hydraulic monitoring system of the present invention generally designated by the numeral 80. In this embodiment a first pressure transducer 82 is installed in connection with the hydraulic cylinder of the squeeze-pad hydraulic system. First pressure transducer 82 generates a first pressure transducer electrical output signal that is fed into the first input 84 of a squeeze-pad pressure comparator 86 A reference signal is supplied to the second input 88 of squeeze-pad pressure comparator 86 from the first output port 90 of a dual digital to analog converter 92.

The reference signal supplied to squeeze-pad comparator 86 is selected by the user through the use of an alarm set point select circuit 94. Alarm set point select circuit includes an eight-bit UP/DOWN counter 96; an UP button 98 connected to the UP count control line of UP/DOWN counter 96 that causes UP/DOWN counter 96 to supply an increased digital value to the input buss of dual digital to analog converter 92 when depressed by a user; and a DOWN button 100 connected to the DOWN count control line of UP/DOWN counter 96 that causes UP/DOWN counter to supply a decreased digital value to the input buss of dual digital to analog converter 92 when depressed by a user.

When the voltage value of the first pressure transducer electrical output signal exceeds the value of the first reference signal squeeze-pad pressure comparator 86 generates an activation signal to a tone generator 102 for an audible alarm device 104 and to a visual alarm device 106.

A first LED display unit 108 is also included to provide a continuous display to the operator of pressure readings within the squeeze-pad cylinder. This is accomplished by routing the first pressure transducer electrical output signal to a first digital is display driver 110. First display driver 110 converts the first pressure transducer electrical output signal into a digital signal suitable for display by first LED display unit 108. If desired first LED display unit 108 may be used to display the squeeze-pad alarm set point by depressing a select button 112. The select button causes a quad bi-lateral switch 114 to switch the output of first output 90 of dual digital to analog converter 92 into the input of display driver 110. This feature is useful when setting the desired alarm set point.

Monitoring system 80 also includes a second pressure transducer 116 that is installed in connection with the hydraulic cylinder of the lift fork hydraulic system. Second pressure transducer 116 generates a second pressure transducer electrical output signal that is fed into the first input 118 of a lift fork pressure comparator 120. A reference signal is supplied to the second input 122 of lift for pressure comparator 120 from a second output port 124 of dual digital to analog converter 92.

The reference signal supplied to fork lift comparator 120 is selected by the user through the use of alarm set point select circuit 94. Depressing select button 112 a first time causes the output from UP/DOWN counter 96 to be loaded into memory and the analog value placed out on first output 90 while simultaneously causing quad bilateral switch 114 to switch the output of first output 90 into the input of display driver 110. Led display 108 then displays the output allowing the user to select the desired squeeze-pad hydraulic pressure alarm set point.

Depressing select button 112 a second time causes the output from UP/DOWN counter 96 to be loaded into memory and the analog value placed out on second output 124 while simultaneously causing quad bilateral switch 114 to switch the output of second output 124 into the input of a second display driver 126 identical to first display driver 110. A second Led display 128 then displays the output allowing the user to select the desired lift fork hydraulic pressure alarm set point. Depressing select button 112 a third time locks the first and second outputs 90,124 at the user selected set point levels and directs the electrical outputs of first and second pressure transducers 82,116 to their respective display driver 110,126

When the second pressure transducer electrical output signal that is fed into the first input 118 of lift fork pressure comparator 120 exceeds the value of the second reference signal, lift fork pressure comparator 120 generates an activation signal to a second tone generator 130 for audible alarm device 104 and to visual alarm device 106.

It can be seen from the preceding description that an alarm device, an improved squeeze-pad hydraulic system for a squeeze truck, and a method for converting an existing squeeze-pad hydraulic system of a squeeze truck into a squeeze-pad hydraulic system that alerts the operator of the squeeze truck when dangerously high hydraulic pressures are approached within the squeeze-pad hydraulic system have been provided.

It is noted that the embodiments of the invention described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A device for alerting the operator of a squeeze truck when a predetermined hydraulic pressure is reached within a squeeze-pad hydraulic system of said squeeze truck, said device comprising:

a first pressure transducer means, installable in connection with said squeeze pad hydraulic system, for generating a first electrical output signal on a first electrical output that is proportional to the pressure sensed by said first pressure transducer means when said first pressure transducer means is installed in connection with said squeeze-pad hydraulic system;

a squeeze-pad pressure comparator having first and second squeeze-pad comparator inputs and a first squeeze pad comparator output;

a squeeze-pad reference signal generating means for generating a reference signal to said squeeze-pad pressure comparator, said squeeze-pad reference signal generating means including a dual digital to analog converter having a first dual digital to analog output thereof in connection with said second squeeze-pad comparator input, and an alarm set point select circuit including an UP/DOWN counter, an UP button connected to an UP count control line of said UP/DOWN counter that causes said UP/DOWN counter to supply an increased digital value to an input buss of said dual digital to analog converter when depressed by a user; and a DOWN button connected to a DOWN count control line of said UP/DOWN counter that causes said UP/DOWN counter to supply a decreased digital value to said input buss of said dual digital to analog converter when depressed by a user;

a tone generator for an audible alarm device having an activation input in connection with said squeeze-pad comparator output and a tone generator output in connection with a said audible alarm device;

a visual alarm device having a visual alarm activation input in connection with said squeeze-pad comparator output;

a first digital display driver having a first display driver analog input in connection with said first electrical output of said first pressure transducer means and a first digital output buss having a digital output value that is proportional to an analog value placed on said first display driver analog input;

a first display unit having a display digital input buss in connection with said first digital output buss of said first display driver, said first display unit providing a human readable display corresponding to a signal value placed on said display digital input buss.

2. The device of claim 1 further including:

a switching means for switching the output of said first output of said dual digital to analog converter into said first display driver analog input.

3. The device of claim 2 further including:

a second pressure transducer means installable in connection with a hydraulic cylinder of a lift fork hydraulic system for generating a second pressure transducer electrical output signal on a second pressure transducer output;

a lift fork pressure comparator having first and second lift fork comparator inputs and a first lift fork comparator output, said first lift fork comparator input being in connection with said second pressure transducer output; and wherein:

said squeeze-pad reference signal generating means includes a second analog output of said dual digital to analog converter in connection with said second lift fork comparator input; said second lift fork comparator output being in connection with a second tone generator for said audible alarm device having a second activation input in connection with said lift fork comparator output and a second output in connection with said audible alarm device.

* * * * *